US006604923B2

(12) United States Patent
Rinella

(10) Patent No.: US 6,604,923 B2
(45) Date of Patent: Aug. 12, 2003

(54) END SEAL FEATURES FOR SCROLL COMPRESSORS

(75) Inventor: Agostino C. Rinella, DuPont, WA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/967,362

(22) Filed: Sep. 28, 2001

(65) Prior Publication Data

US 2003/0063989 A1 Apr. 3, 2003

(51) Int. Cl.[7] ..... F03C 2/00
(52) U.S. Cl. ..... 418/55.2; 418/1
(58) Field of Search ..... 418/55.2, 179, 418/1, 55.4; 277/415, 399

(56) References Cited

U.S. PATENT DOCUMENTS 3,537,713 A * 11/1970 Matthews et al. ..... 277/415
3,965,697 A * 6/1976 Beierwaltes ..... 418/141
4,148,494 A * 4/1979 Zelahy et al. ..... 277/415
4,199,308 A * 4/1980 McCullough ..... 277/399
4,564,343 A * 1/1986 Nakamura et al. ..... 418/55.4
5,035,589 A * 7/1991 Fraser et al. ..... 418/55.2
6,193,487 B1 * 2/2001 Ni ..... 418/55.2

FOREIGN PATENT DOCUMENTS

JP 02086979 A * 3/1990 ..... F04C/18/02
JP 02245490 A * 10/1990 ..... F04C/18/02
JP 06042472 A * 2/1994 ..... F04C/18/02

* cited by examiner

*Primary Examiner*—Thomas Denion
*Assistant Examiner*—Theresa Trieu
(74) *Attorney, Agent, or Firm*—Pillsbury Winthrop LLP

(57) ABSTRACT

A scroll compressor includes a stationary scroll and a moveable scroll. The stationary scroll has a top surface, a bottom surface, and side edges extending between the top surface and the bottom surface. The moveable scroll moves in a path between the side edges of the stationary scroll. The moveable scroll has a top surface, a bottom surface, and side surfaces having side edges extending between the top surface and the bottom surface. At least one of the top surface and the bottom surface of the moveable scroll includes at least one inner ridge and an outer ridge, and a valley is located between each of the at least one inner ridge and the outer ridge.

27 Claims, 5 Drawing Sheets

END SEAL FEATURES FOR SCROLL COMPRESSORS

BACKGROUND OF THE INVENTION

1. Field of the Invention

The present invention generally relates to scroll compressors for refrigeration units. More specifically, the present invention relates to a system, method, and apparatus to minimize the amount of debris contacting the sides of a moveable scroll in a scroll compressor.

2. Discussion of the Related Art

Scroll compressors are well known in the art. Scroll compressors are used in refrigeration systems to compress coolant as part of a cooling process. A typical scroll compressor is comprised of two scrolls. FIG. 1 illustrates a typical scroll compressor 100 utilized in the prior art. The first scroll is a stationary scroll 105 and is physically mounted to a base. A moveable scroll 110 moves in a path between the walls of the stationary scroll 105. As the moveable scroll 110 moves, it tightly contacts the stationary scroll at numerous locations, trapping gas coolant in pockets between the locations at which the moveable scroll 110 contacts the stationary scroll. As the moveable scroll 110 moves in the path between the walls of the stationary scroll 105, the contact points move, pushing the coolant gas trapped between the contact points progressively closer to the center of the scroll compressor 100. As the coolant moves closer to the center, it becomes more compressed, since the pockets continually shrink. As the coolant becomes more and more compressed, its temperature increases. As the compressed coolant gas reaches the center, the pressure becomes so great that the coolant typically liquefies. Once the coolant reaches the center, it is pumped into coils of a cooling system.

The liquid coolant then flows through the coils, where it dissipates heat. After the high pressure liquid coolant has completely flowed through the coils, it reaches an expansion valve, through which it may flow. The expansion valve is similar to a small hole. On one side of the expansion valve is the high pressure liquid coolant, and on the other side is a low pressure area. Once in the low pressure area, the liquid coolant immediately boils and its temperature drops substantially, to a temperature suitable for cooling. The chilled coolant gas may then flow through pipes in the low pressure area until it again reaches the scroll compressor 100, and the process may repeat itself Typical scroll compressors 100 utilize moveable scrolls 110 and stationary scrolls 105 formed of the same material, or of similar materials having similar hardness. However, using materials of the same or similar hardness can be problematic. For example, if debris falls into the scroll compressor 100, into a space between the moveable scroll 110 and the stationary scroll 105, the debris can damage the scroll compressor 100.

FIG. 2 illustrates a sectional view of a typical moveable scroll 110 in the prior art. The moveable scroll 110 typically has a flat top and a flat bottom. Such a design results in a relatively short lifetime because if debris falls into the scroll compressor 100, it may damage either the moveable scroll 110 or the stationary scroll 105 as it falls down into the space between the scrolls and down to the bottom of the scroll compressor 100. Debris with sharp edges that become trapped on the flat surface on the top of bottom of the moveable scroll may cut through the stationary scroll 105 or the moveable scroll 110 and cause leakage. Also, if debris falls on top of the moving scroll, the debris will typically fall off the top and down into the scroll compressor, causing damage and shortening the scroll compressor's usable lifetime.

Also, some moveable scrolls in the art also do not form a tight seal between the top and bottom of the moving scroll and the stationary scroll. This can result in leakage of coolant from the scroll compressor 100.

Accordingly, the scroll compressors 100 in the prior art are all relatively inefficient because they allow too much debris to fall down into the space between the moving scroll and the stationary scroll. As a result, scroll compressors in the art have relatively short useful lifetimes.

DETAILED DESCRIPTION

An embodiment of the present invention includes a moveable scroll in a scroll compressor. The scroll compressor has a stationary scroll and a moveable scroll. The stationary scroll may be physically mounted to a base. The moveable scroll moves in a path within the walls of the stationary scroll. The moveable scroll may move in a clockwise direction, for example, between the walls of the stationary scroll. As the moveable scroll moves, it tightly contacts the stationary scroll at numerous locations, trapping coolant gas in pockets between the locations at which the moving scroll contacts the stationary scroll. As the moveable scroll moves between the walls of the stationary scroll, the contact points move, pushing the coolant gas trapped between the contact points progressively closer to the center of the stationary scroll. As the coolant moves closer to the center, it becomes more compressed, since the pockets continually shrink. As the coolant becomes more and more compressed, its temperature increases. Once the compressed gas reaches the center, it is pumped into coils of a cooling system.

Figure 3:
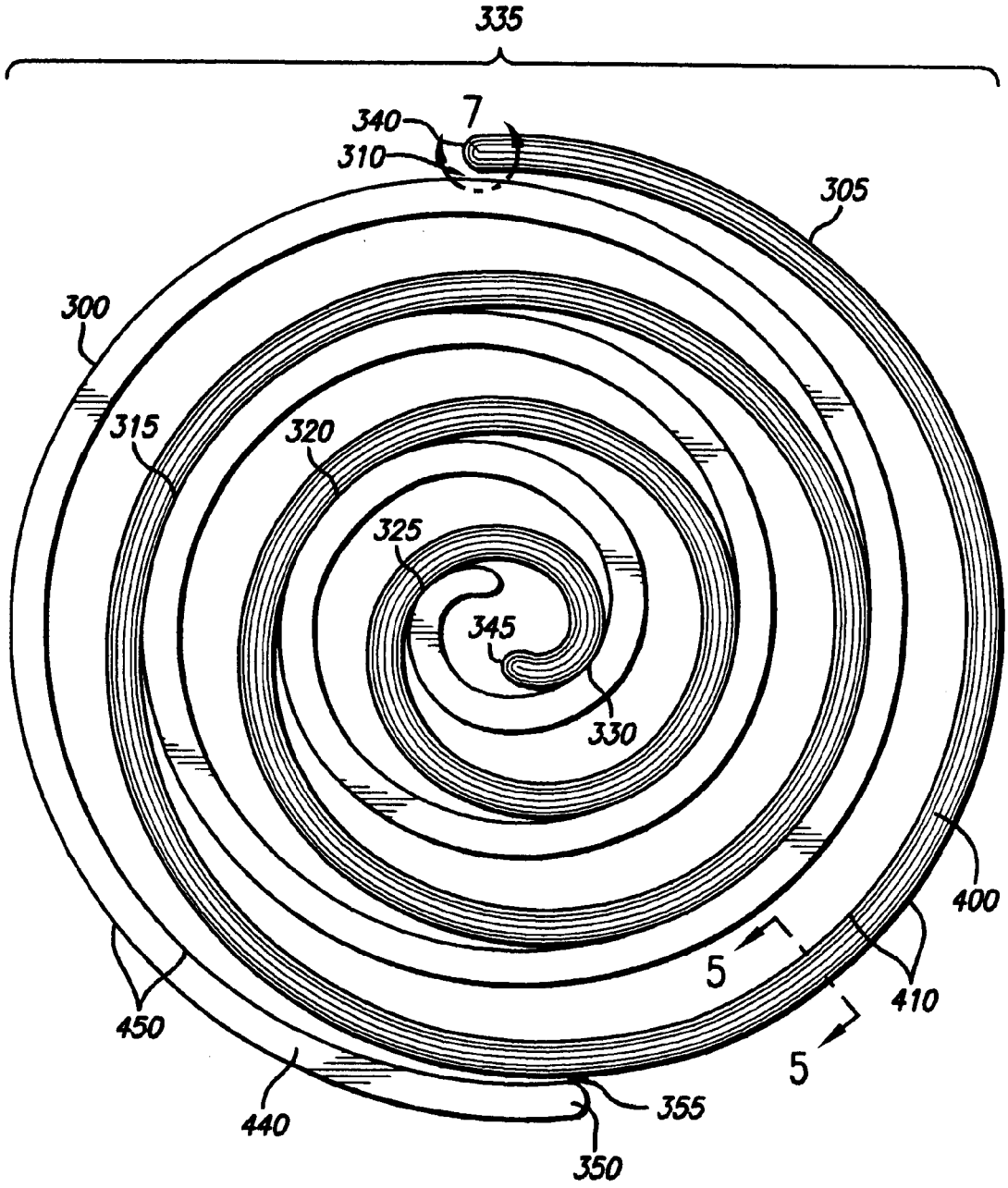
FIG. 3 illustrates a plain view of a scroll compressor according to an embodiment of the present invention.

FIG. 3 illustrates a plain view of a scroll compressor according to an embodiment of the present invention. As shown, the scroll compressor includes a stationary scroll 300 and a moveable scroll 305. Gas coolant may enter the scroll compressor at a location near the outermost end 340 of the moveable scroll 305, in the space 310 between the outermost end 340 of the moveable scroll 305 and the stationary scroll 300. The gas coolant may then move into the space between the outermost end 340 of the moveable scroll 305 and the first point 315 at which the moveable scroll 305 tightly contacts the stationary scroll 300. As the moveable scroll 305 moves, the gas coolant is gradually compressed by the movement of the moveable scroll 305. The scroll compressor 335 gradually forces the gas coolant into a smaller space, increasing the pressure on the gas. Pursuant to the ideal gas law, PV=nRT, the increase in pressure results in an increase in the temperature of the gas, where P=pressure, V=volume, n=the number of moles of the gas, R=the ideal gas constant, or 0.0826 Liters*atmospheres/(moles * degrees Kelvin), and T=temperature. As the gas is compressed, its volume decreases a little bit and its pressure increases greatly. Since n and r are constant (assuming that no gas escapes after it is initially trapped between the moveable scroll 305 and the stationary scroll 300, n must be constant), the temperature of the gas increases. The gas coolant actually is compressed enough so that it liquefies. The warm liquefied coolant may then flow through pipes (not shown) which allow the liquid coolant to radiate heat. Thereafter, the liquid coolant passes through an expansion valve, which has a much lower pressure, allowing the coolant to boil and quickly cool.

Figure 1:
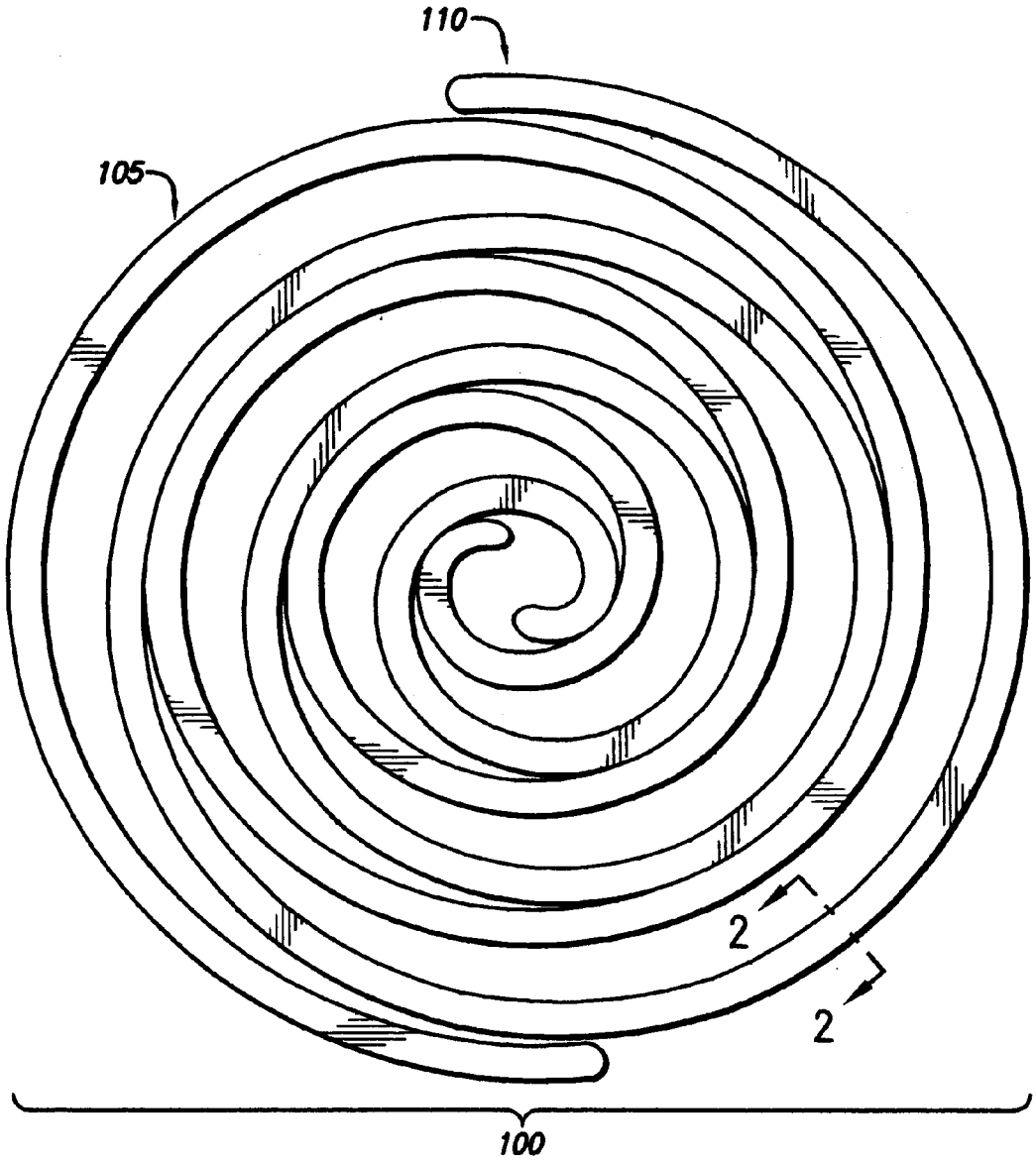
FIG. 1 PRIOR ART
FIG. 1 illustrates typical scroll compressor utilized in the prior art.

As shown in FIG. 3, the gas coolant is initially trapped between the space 310 between the end 340 of the moveable scroll 305 and the stationary scroll 300, and the first contact point 315 where the moveable scroll 305 contacts the stationary scroll 300. The moveable scroll 305 may move in a clockwise path without rotating in an angular direction. In other words, in an embodiment, the moveable scroll 305 does not itself rotate as it moves in the clockwise direction (i.e., as shown in FIG. 1, the outermost end 340 of the moveable scroll would remain directly above the innermost end 345 as the moveable scroll 305 moves in the clockwise direction). In other embodiments, the moveable scroll 305 may rotate as it moves within in a path within the stationary scroll 300. In additional embodiments, the moveable scroll 305 may move in a counterclockwise direction.

The scroll compressor 335 may have a base and a cap. The stationary scroll 300 may be physically mounted within the base, or may be a physical part of the base. The moveable scroll 305 is typically not a physical part of the cap, but may be connected to the cap at a point. In other words, a connection member, or members, may extend down from the cap and physically connect to the top of the moveable scroll 305. The movement of the moveable scroll 305 in the clockwise direction may then be controlled by the cap. In other embodiments, the movement of the moveable scroll 305 may be controlled in any other suitable manner.

As shown in FIG. 3, gas coolant may enter the scroll compressor 300 in the space 310 between the outermost end of the moveable scroll and the stationary scroll 300. As the moveable scroll moves, it traps the gas coolant between the points at which it contacts the stationary scroll 300. A first place where the gas coolant may become trapped is in the space between the end 340 of the moveable scroll 305 and the first contact point 315. The second place where the gas coolant may become trapped is in the space between the first contact point 315 and the second contact point 320. The third place is between the second contact point 320 and the third contact point 325. A fourth place in which the coolant may become trapped is in the space between the third contact point 325 and the fourth contact point 330. As shown, the amount of space between the fourth 330 and third 325 contact points is smaller than the space between the third 325 and second 320 contacts points, as so on. In other embodiments, gas coolant may also enter the bottom of the scroll compressor 335 in the space 355 between the outermost end 350 of the stationary scroll 305 and the moveable scroll 305.

As the moveable scroll 305 moves, the locations of the contact points move. A pocket of gas coolant trapped between contact points is eventually forced into the center of the scroll compressor 335, and become more and more compressed and pressurized as it is forced into the center. As discussed above, the gas coolant may eventually become so pressurized that it liquefies. The coolant heats as it becomes pressurized. After the coolant reaches the center of the scroll compressor 335, it may be forced out of the scroll compressor 335 into heat dissipation pipes, which may cause the coolant to radiate heat. After passing through heat dissipation pipes, the high pressure coolant may pass through an expansion valve, which allows the gas to greatly expand. Consequently, the pressure of the gas greatly decreases, and it may boil immediately, and then drop to a very low temperature. The cooled gas may then be utilized to cool the inside of a computer, or any other device in need of cooling.

Figure 4:
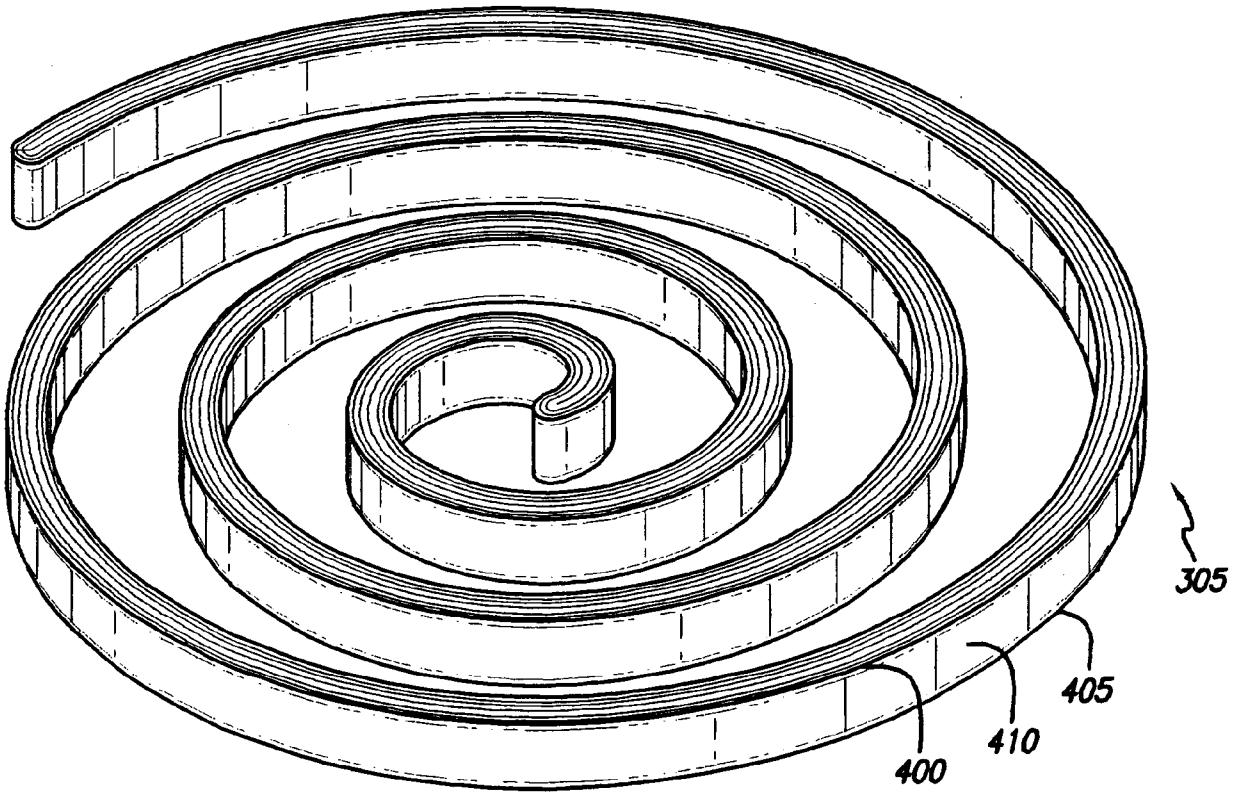
FIG. 4 illustrates a perspective view of a moveable scroll according to an embodiment of the present invention.
Figure 2:
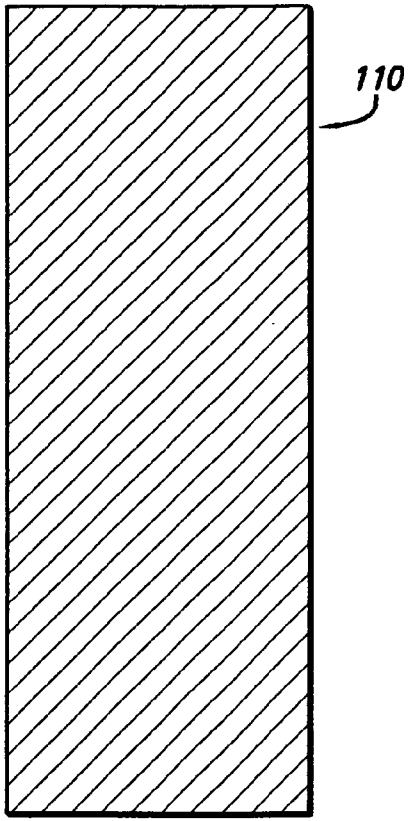
FIG. 2 PRIOR ART
FIG. 2 illustrates a sectional view of a typical moveable scroll in the prior art.

FIG. 4 illustrates a perspective view of a moveable scroll 305 according to an embodiment of the present invention. As shown, the moveable scroll 305 has a top 400 and a bottom 405. Extending between the top 400 and the bottom 405 is a side face 410. The side face 410 may be a flat surface that is perpendicular to the cap and the base of the scroll compressor 335. When situated within the scroll compressor 335, the top 400 and the bottom 405 may extend laterally out slightly farther than the side face, as further discussed below with respect to FIGS. 3 and 4.

Figure 4A:
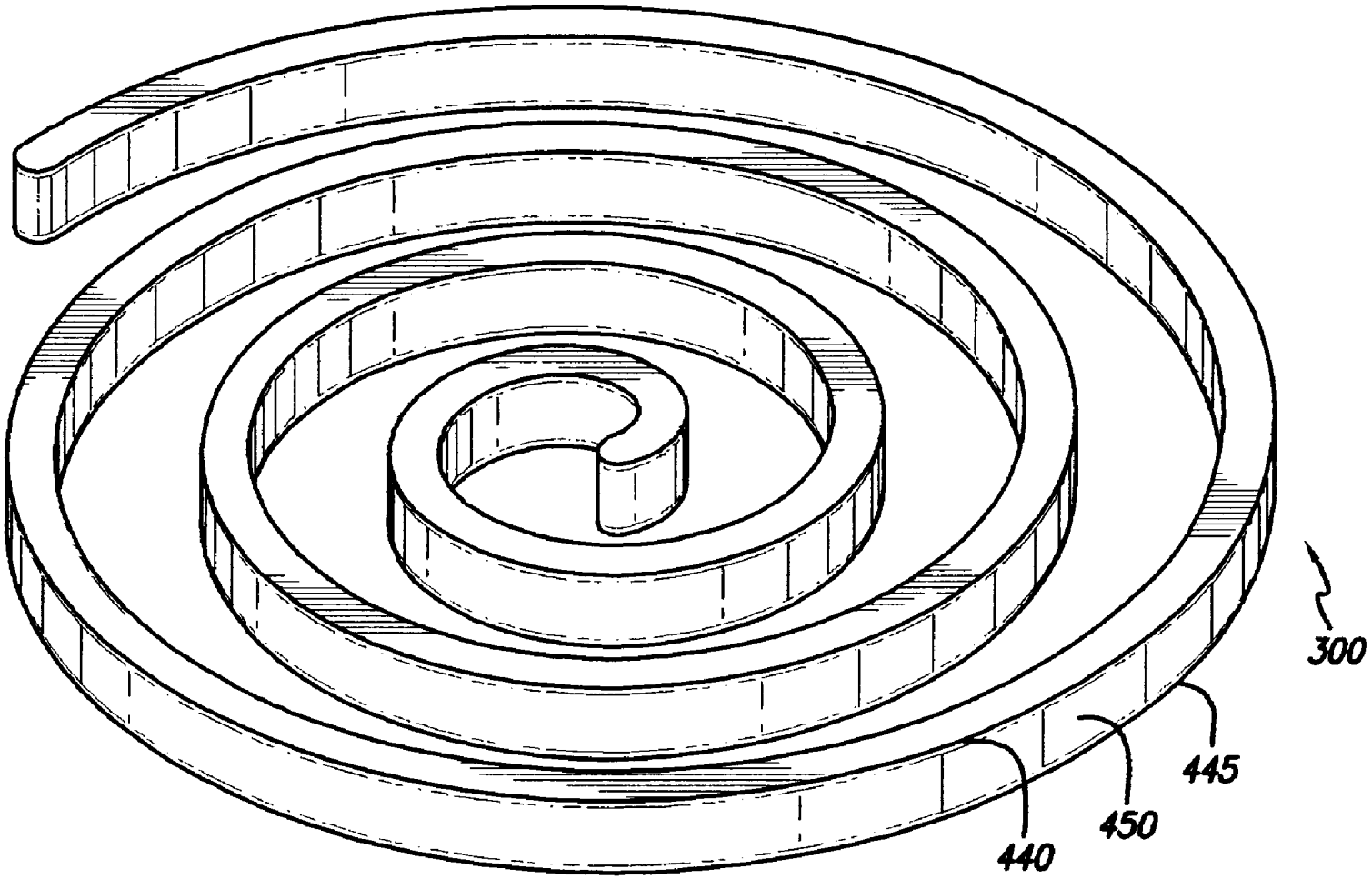
FIG. 4A illustrates a stationary scroll according to an embodiment of the invention.

FIG. 4A illustrate a stationary scroll 300 according to an embodiment of the invention. As shown, the stationary scroll 300 has a top surface 440, a bottom surface 445, and side edges 450.

Figure 5:
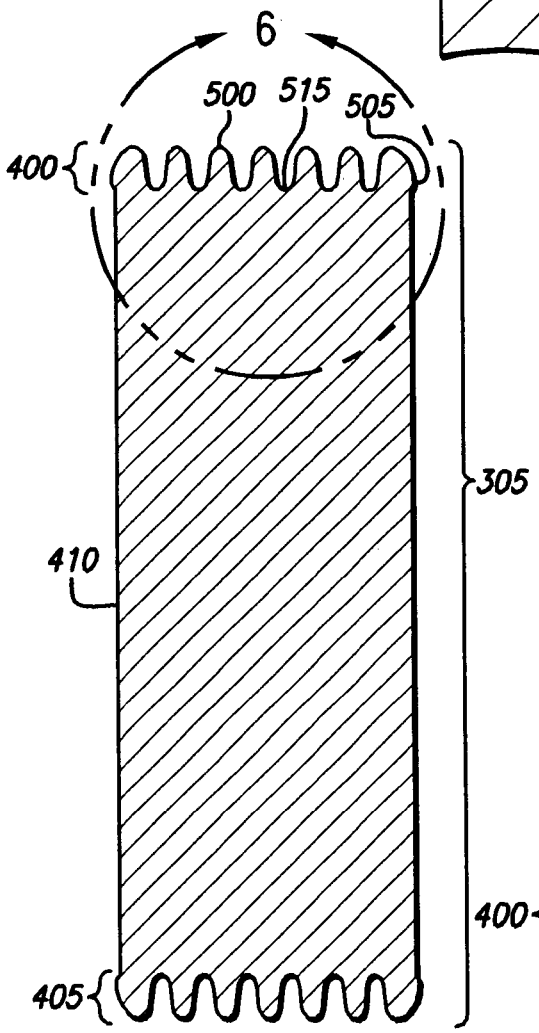
FIG. 5 illustrates a sectional view of a moveable scroll of the scroll compressor from line 5—5 of FIG. 3, according to an embodiment of the present invention.

FIG. 5 illustrates a sectional view of a moveable scroll 305 of the scroll compressor 335 from line 5—5 of FIG. 3, according to an embodiment of the present invention. As illustrated, the top of the moveable scroll 305 has a plurality of ridges 500 on both its top end 400 and its bottom end 405. The ridges 500 may be substantially concentric. The moveable scroll 305 also has a bulged ridge 505 on each side of both its top end 400 and its bottom end 405. The moveable scroll 305 also has parallel side walls 410 extending between the bulged ridges 505 on the right side of the top end 400 and the right side of the bottom end 405, as well as between the left side of the top end 400 and the left side of the bottom end 405. The bulged ridges 505 extend beyond the parallel side walls 410. The bulged ridges 505 are areas of material that protrude beyond the parallel planes of the parallel side walls 410 and form an additional sealant against the wall of the stationary scroll 300. As the moveable scroll 305 moves between the walls of the stationary scroll 300, various points on the side walls 410 of the moveable scroll 305 lie flush against parallel side walls 410 of the stationary scroll 300. The gas coolant becomes trapped between the various locations at which that parallel side walls 410 of the moveable scroll 305 contact the side walls of the stationary scroll 300.

The stationary scroll 300 may be physically mounted in a base. The base and a cap of the scroll compressor 335 may have a groove lying between the walls of the stationary scroll 300. The groove may serve to direct the movement of the moveable scroll 305. The ridges 500 of the moveable scroll 305 may rub against the grooves that direct the movement of the moveable scroll 305. The moveable scroll 305 may be formed of a material that is softer than the material forming the stationary scroll 300. The moveable scroll 305 may be formed of aluminum or plastic, for example, in a situation where the stationary scroll 300 is formed of a harder material such as steel or an iron alloy. The top of the ridges 500 on the top end 400 of the moveable scroll 305 may lie flush against the cap, and the bottom of the ridges 500 on the bottom end 405 of the moveable scroll 305 may lie flush against the base. The ridges 500 serve to prolong the useful life of the moveable scroll 305 by allowing debris that may enter the scroll compressor 335 to become trapped in the valleys 515 between the ridges 500, thereby minimizing the chances of debris falling down into the space between the side wall 410 of the moveable scroll 305 and the side walls of the stationary scroll 300. Debris falling into the moveable scroll 305 may become trapped in the valleys 515. If the debris is large or sharp, it may cut through one or more of the ridges 500. Accordingly, debris may become trapped in the valleys 515 and remain there.

Also, because the moveable scroll 305 is formed of a material that is softer than that forming the stationary scroll 300 and the cap and base, debris trapped in between the moveable scroll 305 and the stationary scroll 300 may typically cut into the moveable scroll 305, but not into the stationary scroll. Such an result may serve to prolong the life of the scroll compressor 335. If the moveable scroll 305 was not formed of a softer material, then the debris would simply remain trapped between the moveable scroll 305 and the stationary scroll 300, and would likely cause scratching an damage to both scrolls 300 and 305, eventually resulting in leakage and a shortened lifetime of the scroll compressor 335. The ridges 500 therefore form multiples barriers to leakage in the scroll compressor 335.

Figure 6:
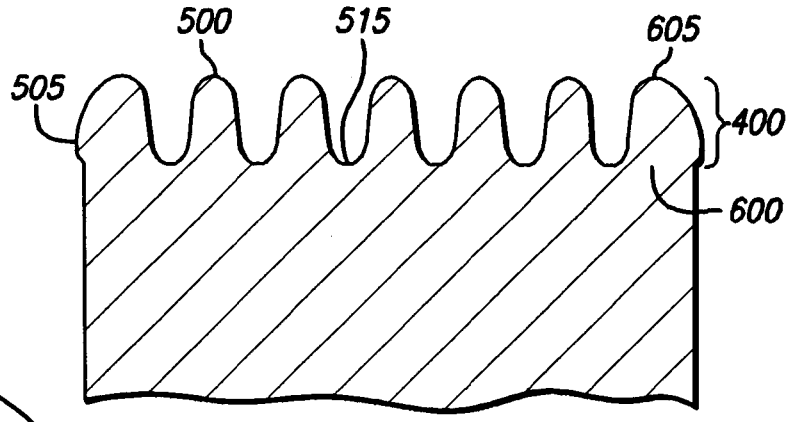
FIG. 6 illustrates a close-up view of the top end of the sectional view of a moveable scroll in a scroll compressor according to an embodiment of the present invention.

FIG. 6 illustrates a close-up view of the top end of the sectional view of the moveable scroll 305 in the scroll compressor 335 according to an embodiment of the present invention. As illustrated, the bulged ridges 505 are wider at their bases 600 than at their bulged ridge tips 605. The bulged ridges 505 serve to form what is known as a "running seal." In other words, as the moveable scroll 305 moves in the groove in the cap and in the base, in the path between the walls of the stationary scroll 300, the bulged ridges 505 bend and serve to enhance the ability of the moveable scroll 305 to form a seal against the stationary scroll 300. Each of the bulged ridges 505, being made of a softer material than the stationary scroll 300, deform along the seal face (i.e., the points at which the stationary scroll 300 contacts the moveable scroll 305), resulting in an enhanced seal.

Figure 7:
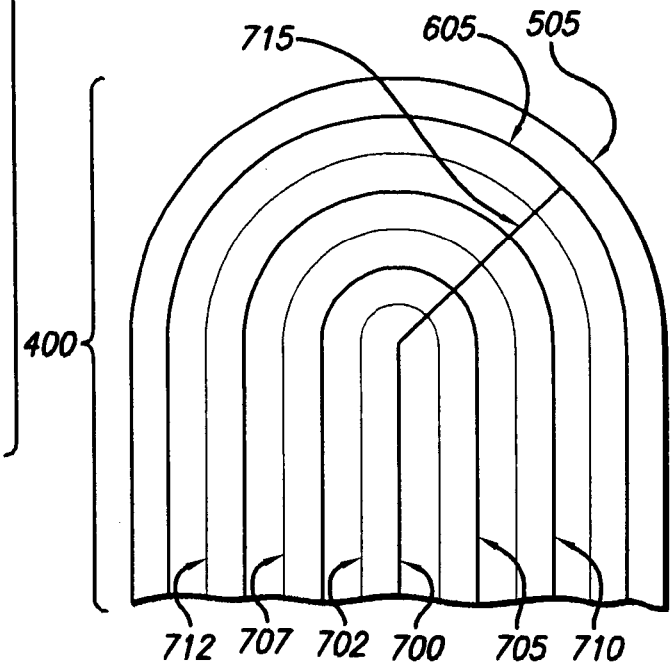
FIG. 7 illustrates an expanded plain view of the top end of the moveable scroll as shown in circle 7 of FIG. 3 according to an embodiment of the present invention.

FIG. 7 illustrates an expanded plain view of the top end 400 of the moveable scroll 305 as shown in circle 7 of FIG. 3 according to an embodiment of the present invention. As illustrated, the top end 400 contains several ridge surfaces, 700, 705, and 710 that each have substantially straight parallel sides and two of the surfaces, 705 and 710 are connected by a curved side. Each of these ridge surfaces are formed by the ridges 500 of the moveable scroll. In other words, the innermost ridge surface 700 is formed by the innermost ridge of the moveable scroll 305. Surrounding the innermost ridge surface 700 is a first adjacent surface 702 that extends in a direction parallel to the innermost ridge surface 700, and wraps around the innermost ridge surface 700 via a curved side. The first adjacent surface 702 is formed by the valleys 515 adjacent to the first ridge 500, as illustrated in FIG. 5. On the other side of the first adjacent surface 702 is a second ridge surface 705. The second ridge surface 705 is formed by the ridges 505 directly adjacent to the innermost ridge surface 700 of the moveable scroll 305. On the side of the second ridge surface 705 opposite the innermost ridge surface 700 is a second adjacent surface 707. The second adjacent surface 707 is formed by the valleys 515 adjacent to the second ridge surface 705, on the side facing away from the innermost ridge surface 700.

Adjacent to the side of the second adjacent surface 707 facing away from the innermost ridge surface 700 is a third ridge surface 710. The third ridge surface 710 is formed by the ridges 505 directly adjacent to the innermost ridge of the moveable scroll 305. On the side of the third ridge surface 710 opposite the innermost ridge surface 700 is a third adjacent surface 712. The third adjacent surface 712 is formed by the valleys 515 adjacent to the third ridge surface 710, on the side facing away from the innermost ridge surface 700. Adjacent to the side of the second adjacent surface 707 facing away from the innermost ridge surface 700 is a an outer ridge surface formed by the bulged ridge tips 605 of the bulged ridges 505. Immediately outside of the outer ridge surface is a outer side surface formed by the bulge 505 of the bulged ridges 505.

A central end ridge 715 extends from the end of the innermost ridge surface 700 through the second ridge surface 705 and the third ridge surface 710, and connects to the outer ridge surface formed by the bulged ridge tips 605. The central end ridge 715 acts like a dam to trap debris caught in the adjacent surfaces 702, 707, or 712 between the ridge surfaces 700, 705, 710 and the outer ridge surface formed by the bulged ridges 605. For example, if debris were to become caught in the first adjacent surface 702, the debris may move around the first adjacent surface 702 until it reaches the central end ridge 715, where it will become trapped. Although FIG. 7 shows the top surface of the moveable scroll 305 near its outermost end, the innermost end may have a similar shape with adjacent surfaces 702, 707, or 712 and ridge surfaces 700, 705, 710, 715 and the outer ridge surface formed by the bulged ridges 605. Other embodiments may include a central end ridge 715 located at a point away from the ends of the moveable scroll 305.

Other embodiments may include more ridges 500. The ridges 500 are designed in such a way so that debris becomes trapped between the ridges 500 and, if the debris is large or sharp, it may cut its way through ridges 500 as it moves toward the center of the moveable scroll 305. Causing the debris to move toward the center serves to minimize the damage caused by debris.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A scroll compressor, comprising:

a stationary scroll having a first top surface, a first bottom surface, and first side edges extending between the first top surface and the first bottom surface; and a moveable scroll to move in a path between the first side edges of the stationary scroll, wherein the moveable scroll has a second top surface, a second bottom surface, and second side surfaces having second side edges extending between the second top surface and the second bottom surface, and wherein at least one of the second top surface and the second bottom surface of the moveable scroll includes at least one inner ridge and an outer ridge, and a valley is located between the at least one inner ridge and the outer ridge, and the moveable scroll is formed of a soft material that is softer than a material forming the stationary scroll.

2. The scroll compressor of claim 1, wherein each of the at least one inner ridge and the outer ridge is substantially concentric.

3. The scroll compressor of claim 1, wherein the scroll compressor includes a cap and a base, and the stationary scroll is physically mounted to the base.

4. The scroll compressor of claim 1, wherein each of the at least one inner ridge and the outer ridge extend along the side surfaces of the moveable scroll.

5. The scroll compressor of claim 4, wherein an end ridge extends between the at least one inner ridge and the outer ridge.

6. The scroll compressor of claim 5, wherein the end ridge is located near an end of the moveable scroll.

7. The scroll compressor of claim 1, wherein the soft material is plastic.

8. A scroll compressor, comprising:

a stationary scroll having a first top surface, a first bottom surface, and first side edges extending between the first top surface and the first bottom surface; and a moveable scroll to move in a path between the first side edges of the stationary scroll, wherein the moveable scroll has a second top surface, a second bottom surface, and second side surfaces having second side edges extending between the second top surface and the second bottom surface, and wherein at least one of the second top surface and the second bottom surface of the moveable scroll includes at least one inner ridge and an outer ridge, and a valley is located between the at least one inner ridge and the outer ridge, and the outer ridge includes a bulge extending beyond the second side edges of the moveable scroll.

9. The scroll compressor of claim 8, wherein the bulge is flexible.

10. A moveable scroll in a scroll compressor, comprising:

a top surface;

a bottom surface;

side surfaces having a side edges extending between the top surface and the bottom surface; and at least one inner ridge and an outer ridge formed in at least one of the top surface and the bottom surface, and a valley is located between the at least one inner ridge and the outer ridge, wherein the at least one inner ridge and the outer ridge are formed of a soft ridge material that is softer than a material forming a stationary scroll of the scroll compressor.

11. The moveable scroll of claim 10, wherein the moveable scroll is formed of a soft material that is softer than a stationary scroll in the scroll compressor.

12. The moveable scroll of claim 11, wherein the soft material is plastic.

13. The moveable scroll of claim 10, wherein each of the at least one inner ridge and the outer ridge is substantially concentric.

14. The moveable scroll of claim 10, wherein the scroll compressor includes a cap and a base.

15. The moveable scroll of claim 10, wherein each of the at least one inner ridge and the outer ridge extend along the side surfaces of the moveable scroll.

16. The scroll compressor of claim 15, wherein an end ridge extends between the at least one inner ridge and the outer ridge.

17. The scroll compressor of claim 16, wherein the end ridge is located near an end of the moveable scroll.

18. The moveable scroll of claim 10, wherein the soft ridge material is plastic.

19. A moveable scroll in a scroll compressor, comprising:

a top surface;

a bottom surface;

side surfaces having a side edges extending between the top surface and the bottom surface; and at least one inner ridge and an outer ridge formed in at least one of the top surface and the bottom surface and a valley is located between each of the at least one inner ridge and the outer ridge, wherein the outer ridge includes a bulge extending beyond the side edges of the moveable scroll.

20. The moveable scroll of claim 19, wherein the bulge is flexible.

21. A method of compressing coolant in a scroll compressor, the method comprising:

inputting the coolant into the scroll compressor;

trapping the coolant between side edges of a moveable scroll and a stationary scroll in the scroll compressor;

trapping debris on a top surface of the moveable scroll, wherein the top surface of the moveable scroll has at least one inner ridge and an outer ridge, and a valley is located between each of the at least one inner ridge and the outer ridge, and the moveable scroll is formed of a soft material that is softer than a material forming the stationary scroll;

compressing the coolant; and outputting the compressed coolant.

22. The method of claim 21, wherein each of the at least one inner ridge and the outer ridge is substantially concentric.

23. The method of claim 21, wherein at a location near an end of the moveable scroll, an end ridge extends between the at least one inner ridge and the outer ridge.

24. The method of claim 23, wherein the end ridge is located near an end of the moveable scroll.

25. The method of claim 21, wherein the soft material is plastic.

26. A method of compressing coolant in a scroll compressor, the method comprising:

inputting the coolant into the scroll compressor;

trapping the coolant between a first side edge of a moveable scroll and a second side edge stationary scroll in the scroll compressor;

trapping debris on a top surface of the moveable scroll, wherein the top surface of the moveable scroll has at least one inner ridge and an outer ridge, and a valley is located between the at least one inner ridge and the outer ridge, wherein the outer ridge includes a bulge extending beyond the second side edge;

compressing the coolant; and outputting the compressed coolant.

27. The method of claim 26, wherein the bulge is flexible.

* * * * *